US008403175B2

(12) United States Patent
Noer et al.

(10) Patent No.: US 8,403,175 B2
(45) Date of Patent: Mar. 26, 2013

(54) CONTAINER WITH FLUID-COLLECTING LIP AND LID WITH PERIPHERAL FLANGE FOR COVERING LIP

(75) Inventors: Torben Noer, Beder (DK); Mikael Koch, Virum (DK); Dorte C. Søndergaard, Taastrup (DK)

(73) Assignee: Superfos A/S, Taastrup (DK)

( * ) Notice: Subject to any disclaimer, the term of this patent is extended or adjusted under 35 U.S.C. 154(b) by 0 days.

(21) Appl. No.: 12/737,151

(22) PCT Filed: Jun. 11, 2009

(86) PCT No.: PCT/EP2009/057244

§ 371 (c)(1),
(2), (4) Date: Mar. 14, 2011

(87) PCT Pub. No.: WO2009/150204

PCT Pub. Date: Dec. 17, 2009

(65) Prior Publication Data

US 2011/0155753 A1 Jun. 30, 2011

(30) Foreign Application Priority Data

Jun. 11, 2008 (EP) ..... 08158027

(51) Int. Cl.
*B65D 43/08* (2006.01)

(52) U.S. Cl. ..... 220/790; 220/789; 220/780

(58) Field of Classification Search ..... 220/790, 220/789, 783, 780, 802, 801, 796, 678, 677, 220/657, 656; *B65D 39/00, 43/08, 43/04*
See application file for complete search history.

(56) References Cited

U.S. PATENT DOCUMENTS

| | | | | |
|---|---|---|---|---|
| 3,335,774 | A * | 8/1967 | Reed | 220/790 |
| 4,458,825 | A * | 7/1984 | Holota | 220/782 |
| 4,606,474 | A * | 8/1986 | Dudzik | 220/781 |
| 4,799,602 | A * | 1/1989 | Collins et al. | 220/789 |
| 5,839,604 | A | 11/1998 | Straussman | |
| 7,721,901 | B1 | 5/2010 | Von Spreckelsen et al. | |
| 2006/0186130 | A1 * | 8/2006 | Jatzke et al. | 220/789 |

FOREIGN PATENT DOCUMENTS

| | | |
|---|---|---|
| CH | 255852 | 2/1949 |
| DE | 8908076 | 10/1989 |
| GB | 2152913 | 8/1985 |
| GB | 2199311 | 7/1988 |
| JP | 2006096363 A * | 4/2006 |

* cited by examiner

*Primary Examiner* — Jacob K Ackun
*Assistant Examiner* — Robert J Hicks
(74) *Attorney, Agent, or Firm* — Dykema Gossett PLLC

(57) ABSTRACT

A container includes a wall, a bottom, a top opening with a peripheral rim and a lid adapted to engage the top opening. The peripheral rim is provided with a fluid-collecting lip extending in an upward and radially outward direction. The lid is provided with a locking edge adapted to wipe the fluid-collecting lip during insertion of the lid into the top opening. The fluid-collecting lip is provided with an upper, thin edge at a radially retracted position relative to the outside surface of the wall of the container. A second part of a peripheral flange of the lid substantially covers the radially outwardly-facing surface of the fluid-collecting lip in the closed position of the lid on the container.

11 Claims, 6 Drawing Sheets

CONTAINER WITH FLUID-COLLECTING LIP AND LID WITH PERIPHERAL FLANGE FOR COVERING LIP

BACKGROUND OF THE INVENTION

1. Field of the Invention

The present invention relates to a container comprising a wall, a bottom, a top opening with a peripheral rim and a lid adapted to engage the peripheral rim of the top opening in a sealing manner in a closed position of the lid on the container, the peripheral rim of the top opening being provided with a fluid collecting lip extending in an upward and radially outwards direction, the fluid collecting lip being provided with a lower locking recess, the lid being provided with a peripheral, radially outwards protruding locking edge adapted to wipe at least a part of the fluid collecting lip during insertion of the lid into the top opening, the radially outwards protruding locking edge of the lid engaging the locking recess of the fluid collecting lip in the closed position of the lid on the container, the lid being provided with a peripheral flange adapted to cover the fluid collecting lip in the closed position of the lid on the container.

2. The Prior Art

U.S. Pat. No. 5,839,604 discloses a lid for a container having an inner rim extending around the top of a side wall. The lid includes a substantially flat central portion, a trough-shaped edge portion comprising a rigid inner wall and an outer wall connected by a bridge element, and a sealing ring on the outer wall for sealingly engaging the inner rim of the container. When stopping pouring from this container, residues of a fluid content may run down the outside of the side wall of the container.

DE-U-8 908 076 similarly discloses a lid for a container, including a substantially flat central portion and a trough-shaped edge portion. This container may have the same disadvantage of residues running down the outside of the container wall.

GB-A-2 152 913 discloses a container lid having a dependent side wall portion at the periphery of its circular centre panel, with one or more deformable annular fins on its outer surface. These fins form an interference fit with a corresponding portion of a container fitted with the lid by deforming and so producing an air-tight and liquid-tight seal. The underside of the lid is provided with a recess in which a tool, such as a screwdriver, may be inserted for opening the lid. An annular lip extending radially out from the outside of the container wall has a spout-formed cross-section and is provided with an enlarged edge portion over which fluid will flow when pouring from the container. Residues may drip from this enlarged edge portion, thereby polluting the outside of the container wall.

SUMMARY OF THE INVENTION

The inventive container is characterized in that the peripheral, radially outwards protruding locking edge (12) of the lid (4) is provided substantially in the same plane as the flat central part of the lid.

It is a well-known problem in the art of containers for storing fluids, such as paint, that fluid may tend to remain on the outside of the container around the lid after re-closing the container after use.

The object of the present invention is to provide a container for storing fluid, whereby the tendency of fluid to remain on the outside of the container after use is reduced.

In view of this object, the container is characterized in that the fluid collecting lip is provided with an upper, thin edge serving to cut over the stream of fluid, when pouring from the container is terminated by bringing the container back to its normal storing position, in that the upper, thin edge is positioned at a radially retracted position relative to the outside of the wall of the container, and in that a second part of the peripheral flange of the lid is adapted to substantially cover the radially outward facing surface of the fluid collecting lip in the closed position of the lid on the container.

Thereby, when terminating the pouring of fluid from the opening of the container, the stream of fluid will be cut off by means of the upper, thin edge of the fluid collecting lip, thereby minimizing spillage from the lip, and furthermore, should small drops nevertheless drip from the upper, thin edge, such drops will not reach the outside of the wall of the container, because the upper, thin edge is positioned at a radially retracted position relative to the outside of the wall of the container, and because the peripheral flange of the lid substantially covers the radially outward facing surface of the fluid collecting lip in the closed position of the lid on the container. Thereby it may be safe-guarded that even small residues of fluid will not be exposed on the outside of the container after use.

In an embodiment, a radial cross-section of a first part of the peripheral flange of the lid corresponds substantially to a radial cross-section of the radially inward facing surface of the fluid collecting lip. Thereby it may be avoided that even small residues of fluid remain trapped between the radially inside face of the fluid collecting lip and the peripheral flange of the lid in the closed position of the lid on the container. The fluid remaining on the fluid collecting lip before mounting the lid on the container may thereby be displaced into the container.

In an embodiment, the peripheral rim of the top opening of the container is provided with an upwardly directed peripheral protrusion, the peripheral flange of the lid is adapted to, in the closed position of the lid on the container, engage radially inside the upwardly directed peripheral protrusion of the top opening, so that a radially outwardly directed displacement of a lower portion of the second part of the peripheral flange of the lid is prevented. Thereby, in the case that the container is unintentionally dropped on the ground, deformation of the lid and possible disengagement of the lid from the container may be avoided, as the lid may be better secured to the container.

In an embodiment, in the closed position of the lid on the container, an annular chamber is formed between the peripheral flange of the lid and the fluid collecting lip, and the upper, thin edge of the fluid collecting lip is positioned at an upper, radially inwardly positioned, preferably smoothly bent, corner of the annular chamber. Thereby, it may be even better safeguarded that residues of fluid following the pouring from the container will be trapped in the annular chamber by the peripheral flange of the lid. This is due to the fact that drops from the upper, thin edge will fall down in the radially inner part of the annular chamber at a distance from the point where the peripheral flange may touch the rim of the container and thereby close the annular chamber against the rim of the container. In the case that the radially inwardly positioned bent corner of the annular chamber is smoothly bent, the upper, thin edge of the fluid collecting lip may abut the smoothly bent corner and thereby contribute to maintaining residues of paint on the radially inner face of the fluid collecting lip.

In an embodiment, the peripheral flange of the lid is adapted to be flush with the outside of a cylindrical wall of the container in the closed position of the lid on the container. Thereby, a smooth surface of the container may be obtained.

In an embodiment, the thin edge of the fluid collecting lip points in a radially outwards direction. Thereby, the stream of fluid may be cut even better off by the thin edge of the fluid collecting lip.

In an advantageous embodiment in terms of manufacture, the fluid collecting lip is provided as a separate ring-formed element welded to a cylindrical wall of the container.

In a structurally advantageous embodiment, the separate ring-formed element forming the fluid collecting lip is provided with downwardly protruding reinforcing ribs.

In an embodiment, the fluid collecting lip has a height that is at least 3, more preferred 4, and most preferred 6, times greater than its thickness. Thereby, a very slim fluid collecting lip may be obtained that may better transform into a suitable thin edge serving to cut over the stream of fluid. Furthermore, the slim fluid collecting lip may be easier to injection mould.

In an embodiment, a grip opening is provided in the peripheral flange of the lid. The grip opening may ensure that the peripheral flange of the lid may easily be lifted by hand in order to open the container. This is an advantage over known containers for which a tool is required in order to open the container.

In an embodiment, at least the fluid collecting lip and/or the lid are made from an elastic material, such as plastic. Thereby, during mounting of the lid on the container, the fluid collecting lip and/or the radially outwards protruding locking edge of the lid may deflect elastically in order for the radially outwards protruding locking edge to come into engagement with the locking recess of the fluid collecting lip in the closed position of the lid on the container.

BRIEF DESCRIPTION OF THE DRAWINGS

The invention will now be explained in more detail below by means of examples of embodiments with reference to the very schematic drawings, in which.

DETAILED DESCRIPTION OF THE PREFERRED EMBODIMENTS

Figure 1:
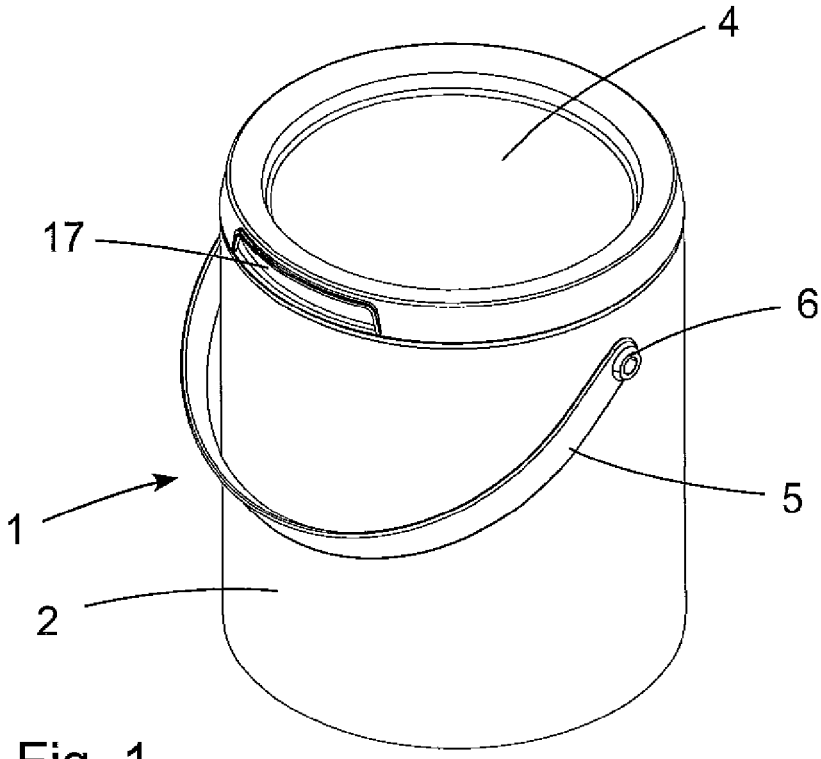
FIG. 1 is a perspective view of a container for storing fluids according to the invention, seen from above.
Figure 2:
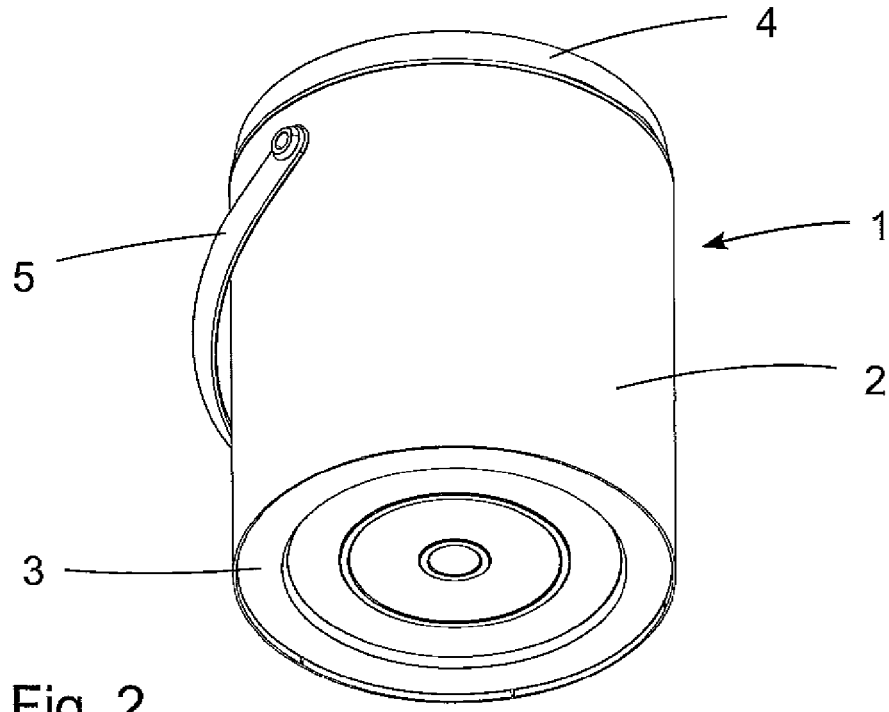
FIG. 2 is a perspective view of the container in FIG. 1, seen from below.
Figure 3:
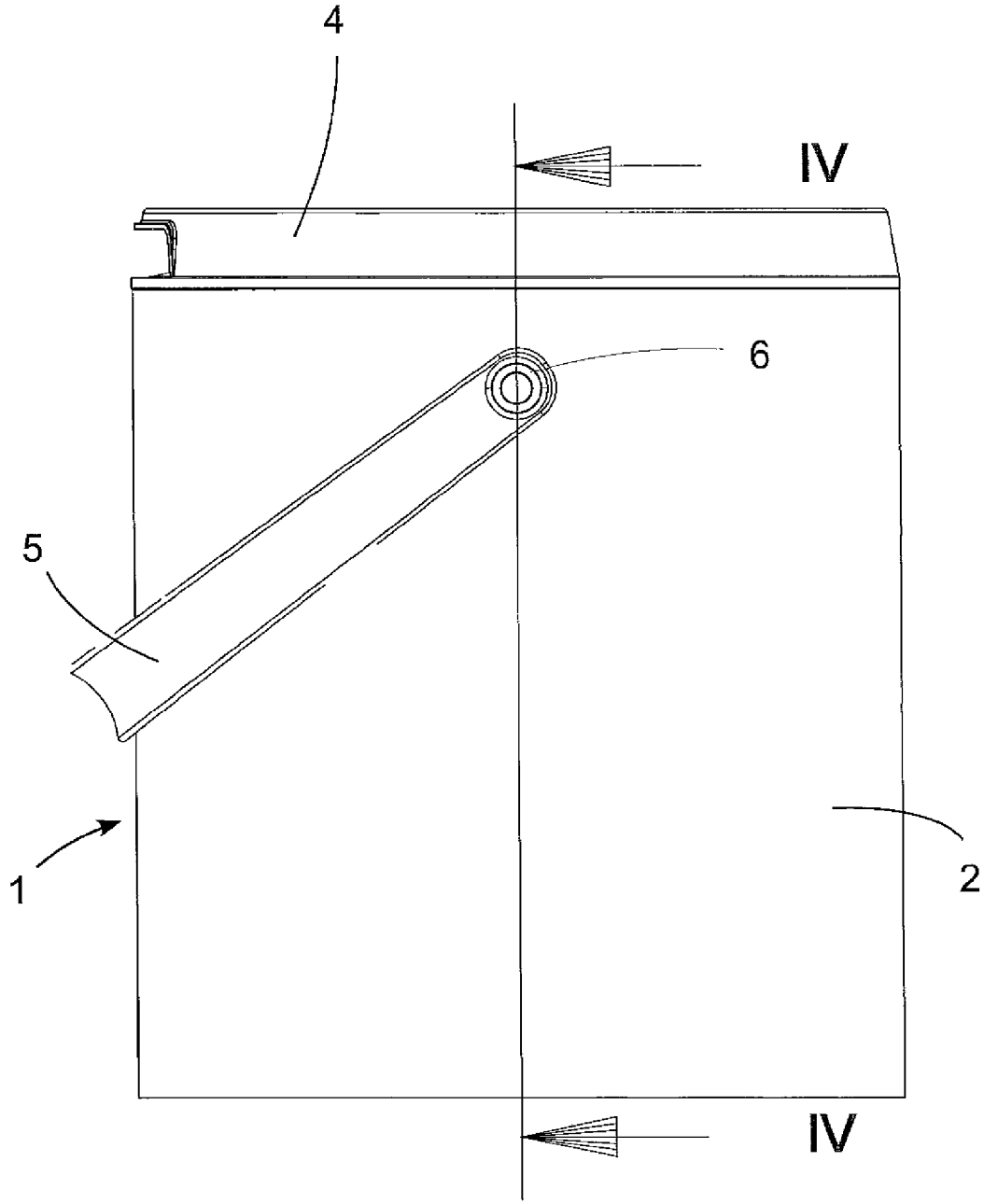
FIG. 3 is a side view of the container in FIG. 1.

FIG. 1 shows a container 1 according to the invention. The container 1 may be used for storing fluids such as paint or the like, but it is also suitable for a large variety of other fluids, powders or other substances, for instance food-stuff or the like. In fact, the container 1 is suitable for any kind of product that is to be stored in a container. The container 1 comprises a cylindrical wall 2, a bottom 3, a lid 4 and a handle 5. The handle 5 is mounted pivotally to the cylindrical wall 2 by means of nipples 6. Preferably, most parts of the container 1 are made of a suitable plastic material; however, other suitable materials may be used.

Figure 4:
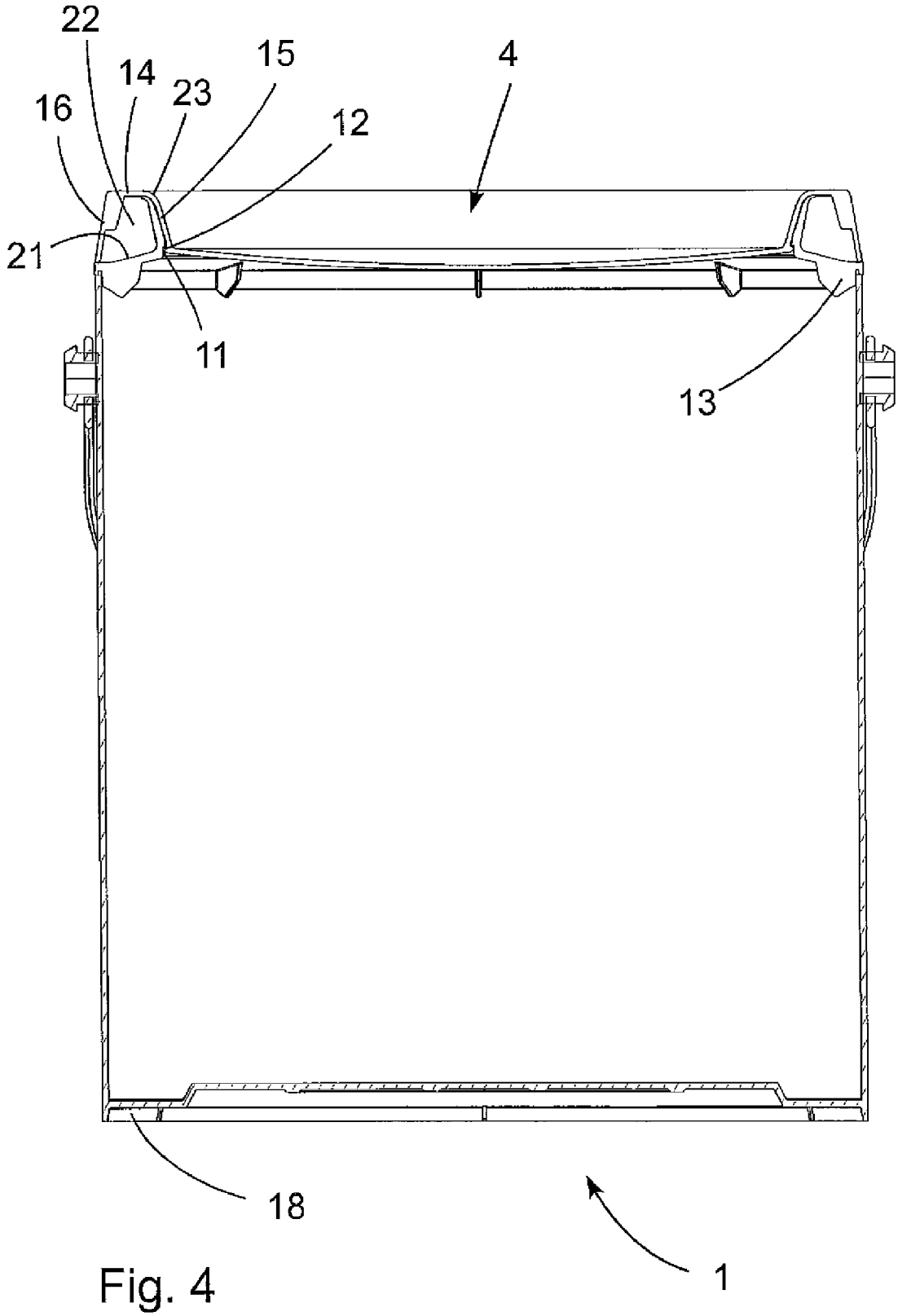
FIG. 4 is an axial section of the container in FIG. 3 along the line IV-IV, in the closed position of the container.
Figure 5:
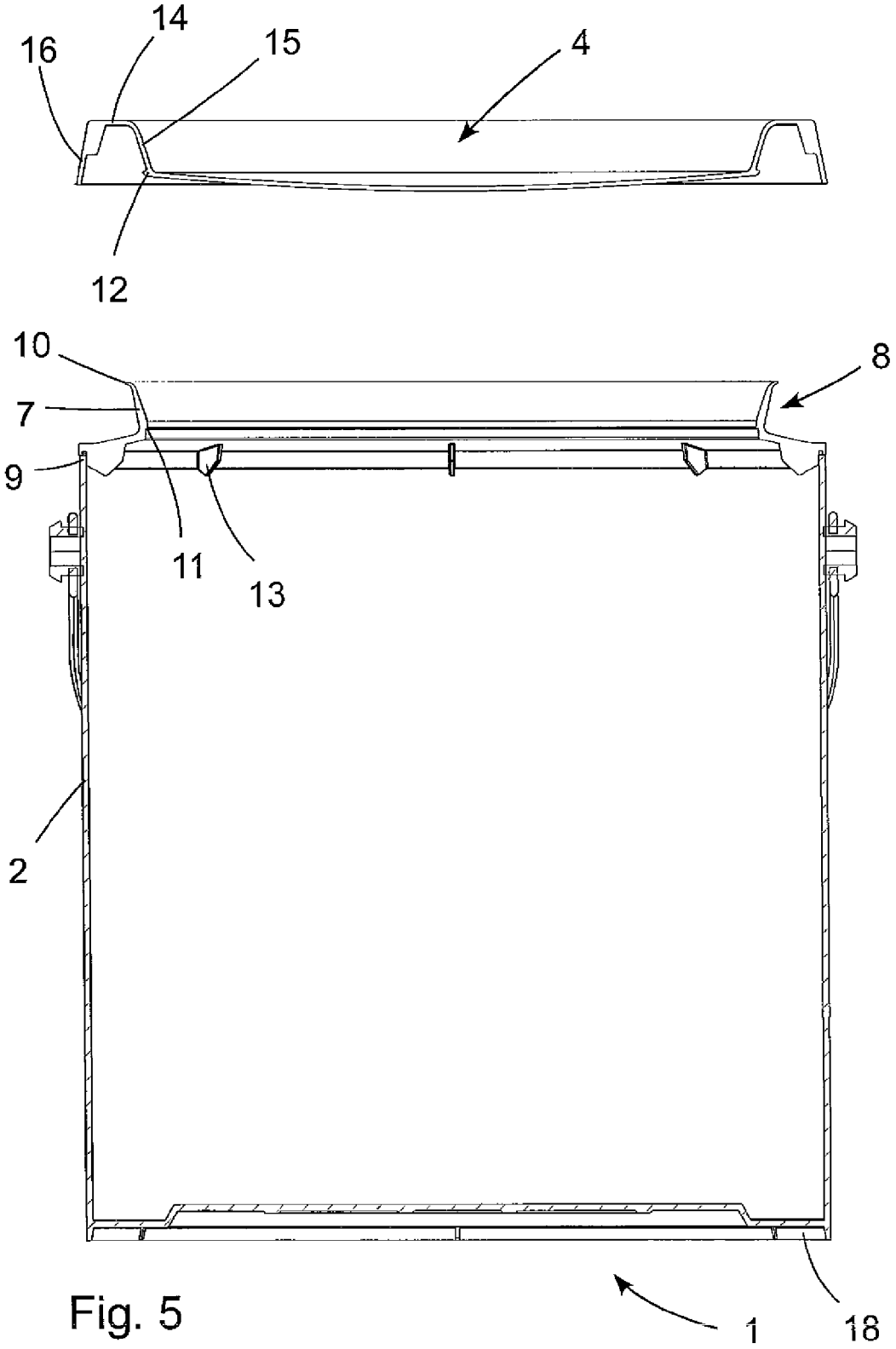
FIG. 5 is an axial section of the container corresponding to that of FIG. 4, but in the open position of the container.

Referring to FIGS. 4 and 5, a fluid collecting lip 7 is provided as a separate ring-formed element 8 welded to an upper rim 9 of the cylindrical wall 2 of the container 1, thereby forming a peripheral rim of a top opening of the container 1. The container 1 itself may consequently be simpler formed, for instance, it may have a constant wall thickness from top to bottom. Thereby, tensions occurring in the material during moulding and resulting shrink marks may be avoided. Furthermore, the container may easier be offset decorated as a simple mandrel may hold the container during the offset process. The fluid collecting lip 7 extends in an upward and radially outwards direction and is provided with an upper, thin edge 10 and a lower locking recess 11. The thin edge 10 of the fluid collecting lip 7 serves to cut over the stream of fluid, when pouring from the container is terminated by bringing the container back to its normal storing position. By cutting over the stream of fluid, the tendency of drops or residues of fluid to remain outside the fluid collecting lip 7 after pouring may be reduced considerably. In the embodiment shown in the figures, the thin edge 10 of the fluid collecting lip points in a radially outwards direction, that is, more or less in the direction of pouring, thereby facilitating a gentle stream of fluid when pouring from the container.

It should be noted that FIGS. 4 and 5 show a cross-section of the container 1 according to the invention, but only the wall 2 and the bottom 3 are hatched in the figures, although also the fluid collecting lip 7 and the lid 4 are sectioned.

The separate ring-formed element forming the fluid collecting lip 7 is preferably flush with the inside of the cylindrical wall 2 of the container in order to ensure a gentle flow of fluid when pouring from the container 1 and in order to avoid fluid residues at the weld connection at the upper rim 9 of the cylindrical wall 2. Furthermore, the separate ring-formed element forming the fluid collecting lip 7 is provided with downwardly protruding reinforcing ribs 13. Although in terms of manufacture it may be preferred to provide the fluid collecting lip 7 as a separate ring-formed element, this element may also be produced integrated with the cylindrical wall 2 of the container 1.

The lid 4 is provided with a peripheral, radially outwards protruding locking edge 12 adapted to engage the locking recess 11 of the fluid collecting lip in the closed position of the lid on the container, as shown in FIG. 4. Furthermore, the radially outwards protruding locking edge 12 of the lid is adapted to wipe at least a part of the radially inward directed surface of the fluid collecting lip 7 during insertion of the lid 4 into the top opening of the container, thereby scraping residues of fluid remaining on the fluid collecting lip 7 down into the container, after finishing the pouring operation. Depending on the angle that the fluid collecting lip 7 forms with the vertical axis of the container 1 and on the elasticity of the fluid collecting lip 7 and of the lid 4, a larger or smaller part of the fluid collecting lip 7 may be wiped by the radially outwards protruding locking edge 12 of the lid. Preferably, at large part of the fluid collecting lip 7 is wiped; however, at the same time a certain amount of elastic force is necessary in order for the locking edge 12 to engage the locking recess 11 and lock the lid 4 onto the container 1 in a secure manner. Preferably, the fluid collecting lip 7 has a height that is at least 3, more preferred 4 and most preferred 6 times greater than its thickness.

The lid 4 is furthermore provided with a peripheral flange 14 adapted to cover the fluid collecting lip 7 in the closed position of the lid 4 on the container 1, see FIG. 4. A radial cross-section of a first part 15 of the peripheral flange 14 of the lid 4 corresponds substantially to a radial cross-section of the radially inward facing surface of the fluid collecting lip 7.

Thereby, residues of fluid may be displaced away from the fluid collecting lip 7 and flow down into the container 1, when the lid is mounted on the container. Furthermore, a second part 16 of the peripheral flange 14 of the lid 4 is adapted to substantially cover the radially outward facing surface of the fluid collecting lip 7 in the closed position of the lid on the container. The second part 16 of the peripheral flange 14 is preferably flush with the outside of the cylindrical wall 2 of the container 1. A grip opening 17 is provided in the second part 16 of the peripheral flange of the lid 4, so that the lid may be lifted by hand.

Figure 8:
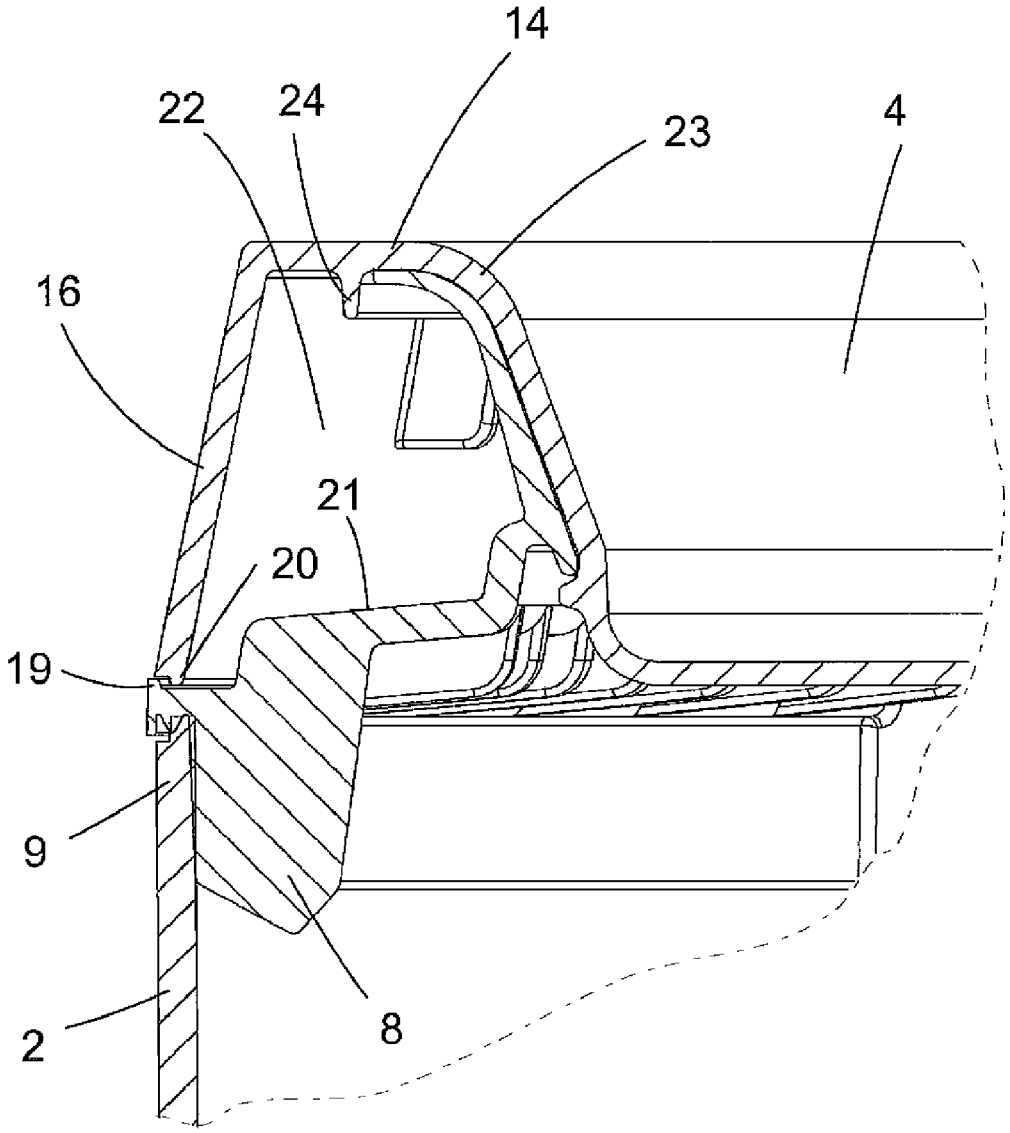
FIG. 8 shows in cross-section a detail of another embodiment of the container according to the invention.

As it may be seen in FIGS. 4 and 8, the upper, thin edge 10 of the fluid collecting lip 7 is positioned at a radially retracted position relative to the outside of the wall 2 of the container 1. Thereby, it may be ensured that small drops, if any, that should fall from the upper, thin edge 10 when stopping the pouring of fluid from the container, may not run directly down onto the outside of the wall 2 of the container, but will first collect at a surface 21 located radially between the position of the upper, thin edge 10 and the outside of the wall 2 of the container. In fact, preferably, in the closed position of the lid 4 on the container, an annular chamber 22 is formed between the peripheral flange 14 of the lid 4 and the fluid collecting lip 7, and the upper, thin edge 10 of the fluid collecting lip 7 is positioned at an upper, radially inwardly positioned, preferably smoothly bent, corner 23 of the annular chamber. Thereby, any fluid residues may be trapped in this chamber, so that they may not reach the outside of the wall of the container. Consequently, the container may be kept cleaner. Furthermore, a downwardly directed protrusion 24 may be provided on the lower side of the peripheral flange 14 in order to close against the upper, thin edge 10 of the fluid collecting lip 7, as shown in FIG. 8. Thereby, an even better closure of the container may be obtained. Furthermore, this downwardly directed protrusion 24 may keep possible fluid residues away from the grip opening 17.

As it may be seen in FIGS. 4, 5 and 8, the peripheral, radially outwards protruding locking edge 12 of the lid 4 may preferably be provided substantially in the same plane as the flat central part of the lid. This may contribute to an easy opening and closing operation of the container in that a suitable flexibility of the peripheral, radially outwards protruding locking edge 12 may be provided by the flat central part of the lid. Thereby, it may be obtained that the lid may be removed from the container simply by lifting the lid by the grip opening 17 by means of a finger and pressing down on the flat central part of the lid, whereby the peripheral, radially outwards protruding locking edge 12 disengages from the locking recess 11 of the fluid collecting lip. Similarly, the lid may be locked onto the container simply by pressing on the peripheral part of the lid and subsequently on the flat central part of the lid, whereby the peripheral, radially outwards protruding locking edge 12 of the lid engages the locking recess 11 of the fluid collecting lip with a distinct click-sound, thereby indicating that the lid is securely locked onto the container. It is an advantage that the container may easily be opened and closed by hand, as known containers of comparable type require a tool for the opening process.

Preferably, the bottom 3 of the container 1 has a recess 18 that fits on top of the peripheral flange 14 or some other part of the lid 4, so that more containers 1 may be stacked on top of each other.

Figure 6:
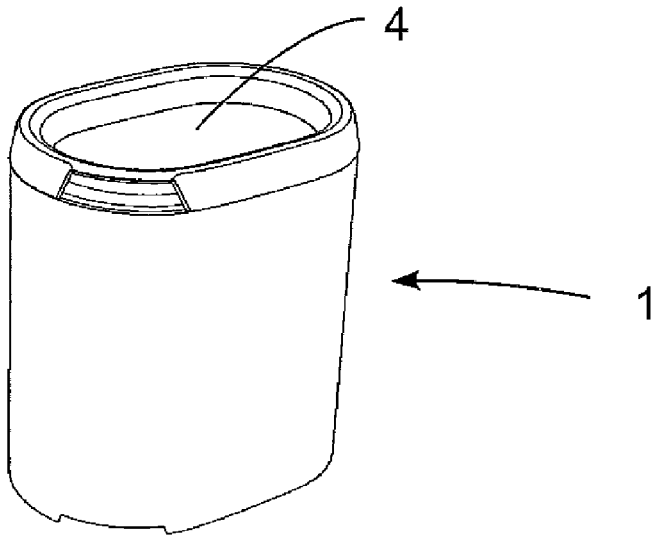
FIGS. 6 and 7 show another embodiment of the container according to the invention, in the closed and open state, respectively.
Figure 7:
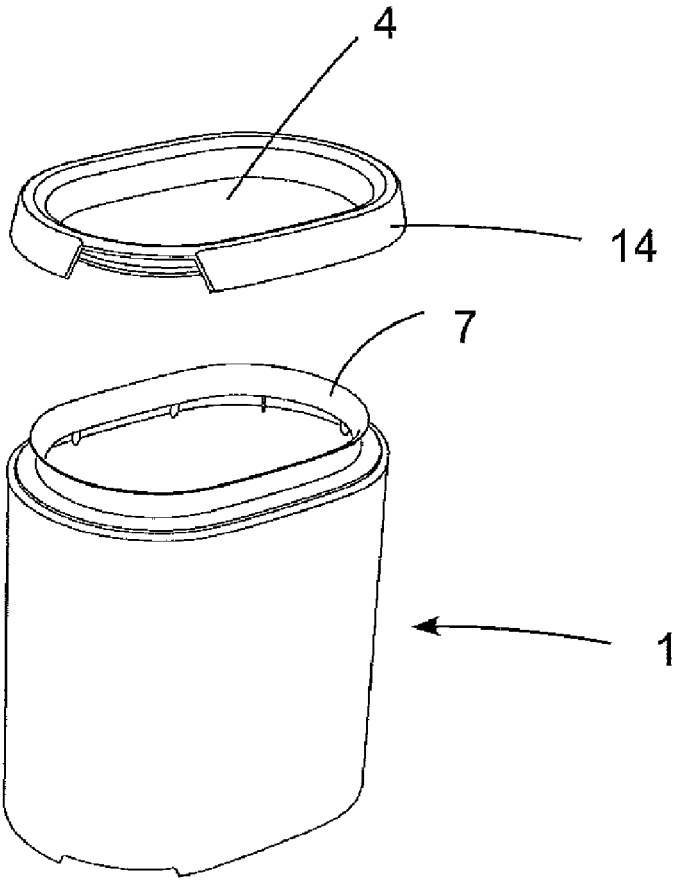

FIGS. 6 and 7 show another embodiment of the container 1 according to the invention. In this embodiment, the container has an oval or oval-like cross-section, but the cross-section may also be of any other suitable shape. The lid 4 is provided with a peripheral flange 14 adapted to cover a fluid collecting lip 7 in the closed position of the lid 4 on the container 1 just as in the embodiment shown in FIGS. 1 to 5. The handle 5 may, of course, be mounted in any suitable way; for instance, in the embodiment shown in FIGS. 6 and 7, the handle 5 could extend along the short dimension of the oval cross-section of the container, but it could also extend along the long dimension of the oval cross-section.

FIG. 8 shows a detail of an embodiment of the container 1 according to the invention. In this embodiment, the peripheral rim of the top opening of the container 1 is provided with an upwardly directed peripheral protrusion 19 in order to better maintain the peripheral flange 14 of the lid 4 in place in the mounted position of the lid on the container. A lower portion 20 of the second part 16 of the peripheral flange 14 of the lid 4 is adapted to, in the closed position of the lid on the container shown in the figure, engage radially inside the upwardly directed peripheral protrusion 19 of the top opening, so that a radially outwardly directed displacement of the lower portion 20 of the second part 16 of the peripheral flange 14 prevented. The upwardly directed peripheral protrusion 19 may, as shown, form a part of the separate ring-formed element 8 welded to an upper rim 9 of the container 1; however, it may also form part of the rim 9 itself.

The invention claimed is:

1. A container comprising a wall, a bottom, a top opening with a peripheral rim, and a lid adapted to engage the peripheral rim of the top opening in a sealing manner in a closed position of the lid on the container, the peripheral rim of the top opening being provided with a fluid collecting lip extending in an upward and radially outward direction, the fluid-collecting lip being provided with a lower locking recess, the lid including a flat central part and a peripheral, radially outwardly-protruding locking edge adapted to wipe at least a part of the fluid-collecting lip during insertion of the lid into the top opening, the radially outwardly-protruding locking edge of the lid engaging the lower locking recess of the fluid-collecting lip in a closed position of the lid on the container, the lid being provided with a peripheral flange covering the fluid-collecting lip in the closed position of the lid on the container, the fluid-collecting lip being provided with an upper, thin edge serving to cut over the stream of fluid when pouring from the container is terminated by bringing the container back to a normal storing position, the upper, thin edge being positioned at a radially-retracted position relative to an outside surface of the wall of the container, and the peripheral flange of the lid includes an outer part which covers the radially outward-facing surface of the fluid-collecting lip in the closed position of the lid on the container, and wherein the peripheral, radially outwardly protruding locking edge of the lid is located substantially in a plane defined by the flat central part of the lid.

2. The container according to claim 1, wherein the peripheral rim of the top opening of the container includes an upwardly-directed peripheral protrusion, and the outer part of this peripheral flange of the lid defines a lower portion which engages radially inside the upwardly-directed peripheral protrusion of the top opening, to prevent radially outwardly-directed displacement.

3. The container according to claim 1, wherein in the closed position of the lid on the container, an annular chamber is formed between the peripheral flange of the lid and the fluid-collecting lip, and the upper, thin edge of the fluid-collecting lip is positioned at an upper, radially inwardly positioned.

4. The container according to claim 1, wherein the peripheral flange of the lid is flush with the outside of the wall of the container in the closed position of the lid on the container.

5. The container according to claim 1, wherein the thin edge of the fluid-collecting lip points in a radially outward direction.

6. The container according to claim 1, wherein the fluid-collecting lip is a separate ring-formed element welded to the wall of the container.

7. The container according to claim 6, wherein the separate ring-formed element forming the fluid-collecting lip includes downwardly-protruding reinforcing ribs.

8. The container according to claim 1, wherein the fluid collecting lip has a height that is at least three times greater than a thickness thereof.

9. The container according to claim 1, wherein a grip opening is provided in the peripheral flange of the lid.

10. The container according to claim 1, wherein at least one of the fluid-collecting lip and the lid consists of an elastic material.

11. The container according to claim 8, wherein the height of the fluid-collecting lip is four times greater than the thickness thereof.

* * * * *

UNITED STATES PATENT AND TRADEMARK OFFICE

CERTIFICATE OF CORRECTION

PATENT NO. : 8,403,175 B2
APPLICATION NO. : 12/737151
DATED : March 26, 2013
INVENTOR(S) : Noer et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 40 days.

Signed and Sealed this
First Day of September, 2015

Michelle K. Lee

Michelle K. Lee
*Director of the United States Patent and Trademark Office*